US009724756B2

(12) United States Patent
Barrett

(10) Patent No.: US 9,724,756 B2
(45) **Date of Patent: *Aug. 8, 2017**

(54) REFRACTORY COMPONENT FOR LINING A METALLURGICAL VESSEL

(71) Applicant: North American Refractories Company, Moon Township, PA (US)

(72) Inventor: Ronald L. Barrett, Fenelton, PA (US)

(73) Assignee: NORTH AMERICA REFRACTORIES COMPANY, Moon Township, PA (US)

( * ) Notice: Subject to any disclaimer, the term of this patent is extended or adjusted under 35 U.S.C. 154(b) by 157 days.

This patent is subject to a terminal disclaimer.

(21) Appl. No.: 14/273,962

(22) Filed: May 9, 2014

(65) Prior Publication Data

US 2015/0321251 A1 Nov. 12, 2015

(51) Int. Cl.
*B22D 41/02* (2006.01)
*B22D 41/00* (2006.01)

(52) U.S. Cl.
CPC ..... *B22D 41/00* (2013.01); *B22D 41/003* (2013.01); *B22D 41/02* (2013.01)

(58) Field of Classification Search
CPC ..... B22D 41/003; B22D 41/02; B22D 41/00
USPC ..... 266/44, 200, 236, 275, 286, 283
See application file for complete search history.

(56) References Cited

U.S. PATENT DOCUMENTS

| | | | | |
|---|---|---|---|---|
| 4,909,484 | A * | 3/1990 | Sutor | B22D 41/02 266/275 |
| 5,879,616 | A * | 3/1999 | Erny | B22D 41/02 266/236 |
| 5,948,349 | A * | 9/1999 | Beurotte | B22D 41/02 266/275 |
| 6,673,306 | B2 | 1/2004 | Abrino et al. | 266/275 |
| 6,787,098 | B2 | 9/2004 | Abrino et al. | 266/44 |
| 7,056,469 | B2 | 6/2006 | Nosbisch | 266/283 |
| 9,126,265 | B2 * | 9/2015 | Barrett | B22D 41/02 266/283 |
| 2016/0039002 | A1 * | 2/2016 | Barrett | B22D 41/02 266/283 |

FOREIGN PATENT DOCUMENTS

| | | | |
|---|---|---|---|
| JP | H 0631435 | 2/1994 | B22D 41/02 |

OTHER PUBLICATIONS

U.S. Appl. No. 14/019,648, Barrett.

* cited by examiner

*Primary Examiner* — Scott Kastler
*Assistant Examiner* — Michael Aboagye
(74) *Attorney, Agent, or Firm* — Kusner & Jaffe

(57) ABSTRACT

In a metallurgical vessel used for handling molten metal, a preformed refractory component forms part of a refractory structure that covers the bottom wall and side wall of the metallurgical vessel. The preformed refractory component is generally cup-shaped and formed of high-temperature refractory materials.

13 Claims, 4 Drawing Sheets

REFRACTORY COMPONENT FOR LINING A METALLURGICAL VESSEL

FIELD OF THE INVENTION

The present invention relates generally to refractory linings for metallurgical vessels and, more particularly, to a component for forming a lining for such vessels. The invention is particularly applicable for use in ladles used in handling molten steel and will be described with particular reference thereto. It will, of course, be appreciated that the present invention has application in other types of metallurgical vessels for handling molten metal.

BACKGROUND OF THE INVENTION

The handling of high-temperature liquids, such as molten steel, requires special materials and techniques. Ladles used for handling molten steel are comprised of an outer metallic shell that is lined with a refractory material. The inner surface of the metallic shell is typically lined with one or more layers of a refractory material, often brick, that can withstand extremely high temperatures and harsh, abrasive conditions. As will be appreciated, the process of laying refractory bricks within a steel ladle is very labor intensive and expensive. In this respect, workers must manually lay courses of bricks along the bottom and sides of the ladle.

Recent developments in forming precast ladle bottoms have eliminated the need for workers to lay bricks on the bottom of the ladle. In this respect, U.S. Pat. Nos. 6,673,306 and 6,787,098, both to Abrino et al., disclose precast ladle bottoms that can be inserted into the bottom of a steel ladle in one piece. While such a structure eliminates the need to brick the bottom of the ladle, it does not eliminate laying bricks along the sides of the ladle. Despite the problems that were solved by the use of precast ladle bottoms, ladle side walls are often still constructed of brick, presenting a similar problem with respect to labor costs and the potential ergonomic issues confronted by the brick layers.

In this respect, the typical method of bricking the side walls around a preformed bottom lining involves lowering a pallet full of brick onto a bottom lining, using a crane. Once the pallet of bricks is within the ladle, laborers descend into the ladle using a ladder and proceed with laying the brick. The laborer begins laying the first course of brick at his feet and must work around the pallet of bricks within the ladle.

Moreover, the first course of bricks is often a starter set of bricks that creates a ramp such that subsequent bricks that form the lining of the side walls spiral up the walls of the ladle. Such starter bricks further require special attention to insure the proper ramp is established by the first course of bricks. Because space is restricted due to the presence of the pallet of bricks within the ladle, laying bricks creates ergonomic problems for the laborers. Even as the height of the brick increases as the side wall is constructed, the repetitive movements of taking bricks from the pallet and placing them into the side walls can cause ergonomic problems.

To date, the only solution to laying brick side walls in steel ladles has been to cast the ladle side wall. To cast a ladle side wall, a form or "mandrel" is placed into the ladle so that a space is defined between the form and the side wall of the ladle. One or more castable materials can be placed or poured between the form and the side wall to create the refractory lining. Casting ladle side walls in this manner requires the fabrication of the form or mandrel and further creates problems with respect to the poured or cast material. In this respect, controlled dry-out procedures are necessary to insure that the cast refractory lining remains intact without steam spalling. In this respect, care must be taken to insure that all water is dried out of the cast refractory lining before use. The creation of steam from residual water can create a dangerous condition when hot liquid steel flows into the ladle during use. Still further, the costs of cast refractory material that can withstand the high temperature and corrosive environment of the steel ladle are typically fairly high. Thus, despite the undesirable working conditions and costs, lining steel ladles with refractory bricks is still a preferred course of action.

The present invention provides a preformed refractory component and side wall structure that mitigate the ergonomic issues confronting laborers in lining a steel ladle with bricks.

SUMMARY OF THE INVENTION

In accordance with a preferred embodiment of the present invention, there is provided a preformed refractory component for use in a steel ladle used for handling molten steel. The steel ladle has an outer metallic shell comprised of a bottom wall, a side wall and a first layer of refractory material lining the side wall. The preformed refractory component forms part of a refractory structure disposed above the bottom wall of the steel ladle. The preformed refractory component is formed of high-temperature refractory materials. The preformed refractory component has a bottom wall portion and an annular side wall portion that is integrally formed with the bottom wall and that extends upwardly therefrom. The bottom wall portion has a bottom surface dimensioned to rest upon a bottom surface of the steel ladle. The annular side wall portion forms part of the working lining of the ladle barrel and has an upper surface that will accommodate or mate with the refractory brick or refractory components used in constructing the remainder of the ladle side wall.

An advantage of the present invention is a refractory lining for the bottom and side wall of a metallurgical vessel.

Another advantage of the present invention is a lining as described above wherein a portion of the lining is a cast refractory.

A still further advantage of the present invention is a lining as described above, the bottom of which is constructed from a preformed refractory component.

A still further advantage of the present invention is a lining as described above wherein the preformed refractory component is formed outside the ladle for insertion into the metallurgical vessel.

A still further advantage of the present invention is a lining as described above that includes a refractory lining along the sides of the metallurgical vessel.

Another advantage of the present invention is a lining as described above including a preformed refractory component having a starter ramp on the upper surface thereof to begin a spiraling course of brick along the side wall of the ladle.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
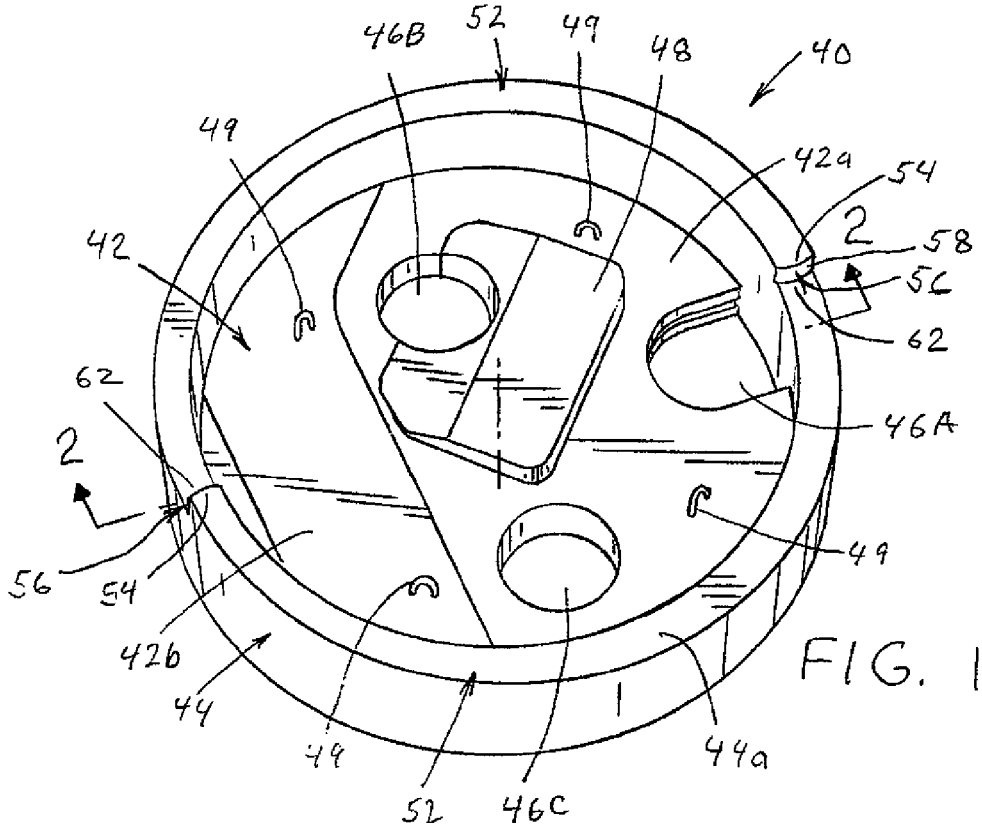
FIG. 1 is a perspective view of a preformed refractory component for use in lining a steel ladle, illustrating a preferred embodiment of the present invention.

Referring now to the drawings wherein the showings are for the purpose of illustrating a preferred embodiment of the invention only and not for the purpose of limiting same, FIG. 1 shows a preformed refractory component 40 for use in forming a refractory barrel lining for a metallurgical vessel. The invention is particularly applicable to a steel ladle 10 used in handling molten steel and will be described with particular reference thereto. However, it will be appreciated from a further reading of the specification that the invention is not limited to a steel ladle 10, but may find advantageous application for linings used in other types of metallurgical vessels handling molten metal.

Figure 4:
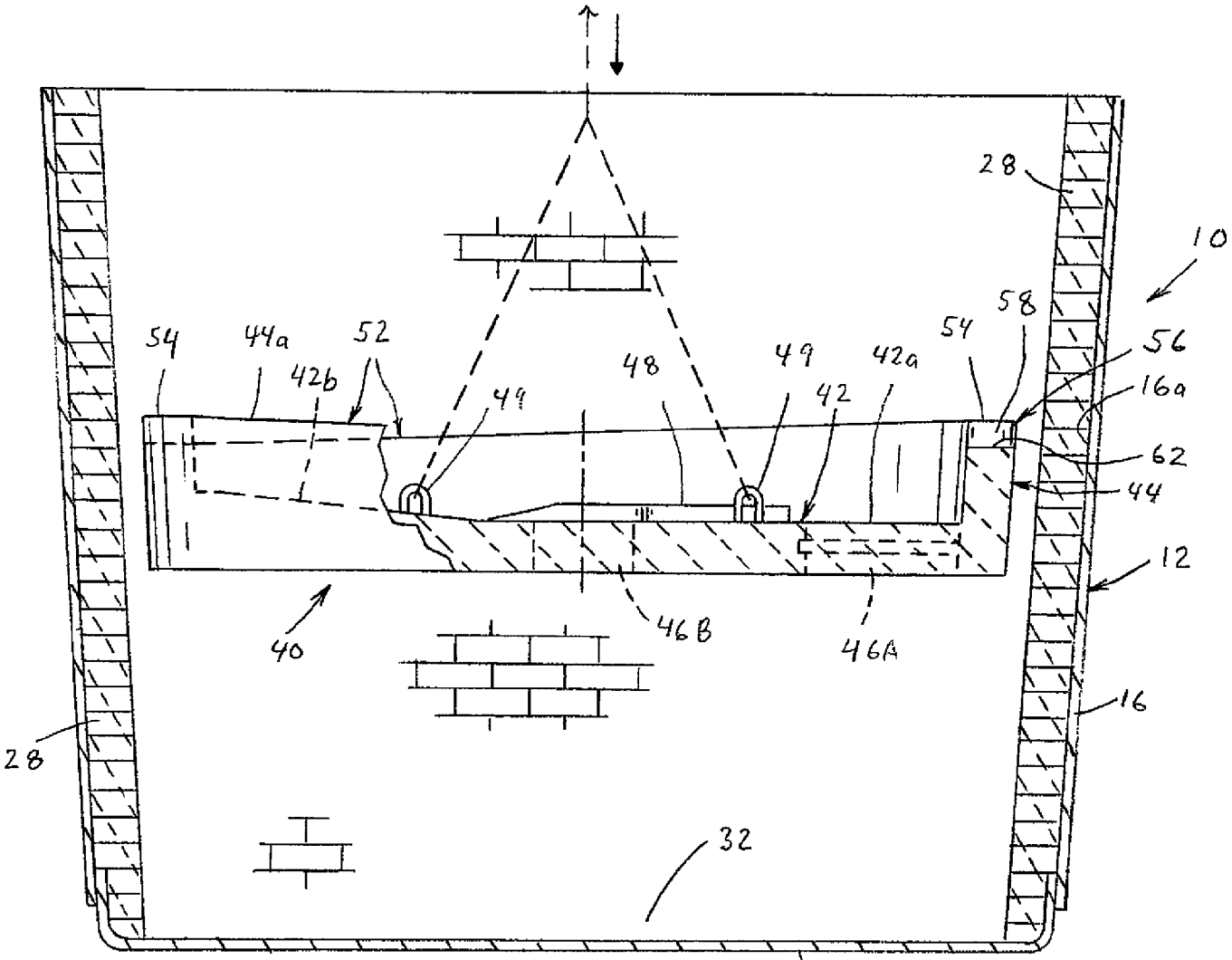
FIG. 4 is a sectional view of a steel ladle having an outer layer of refractory brick forming a permanent lining, showing a preformed refractory component according to the present invention being placed within the ladle by a lifting device (not shown)
Figure 5:
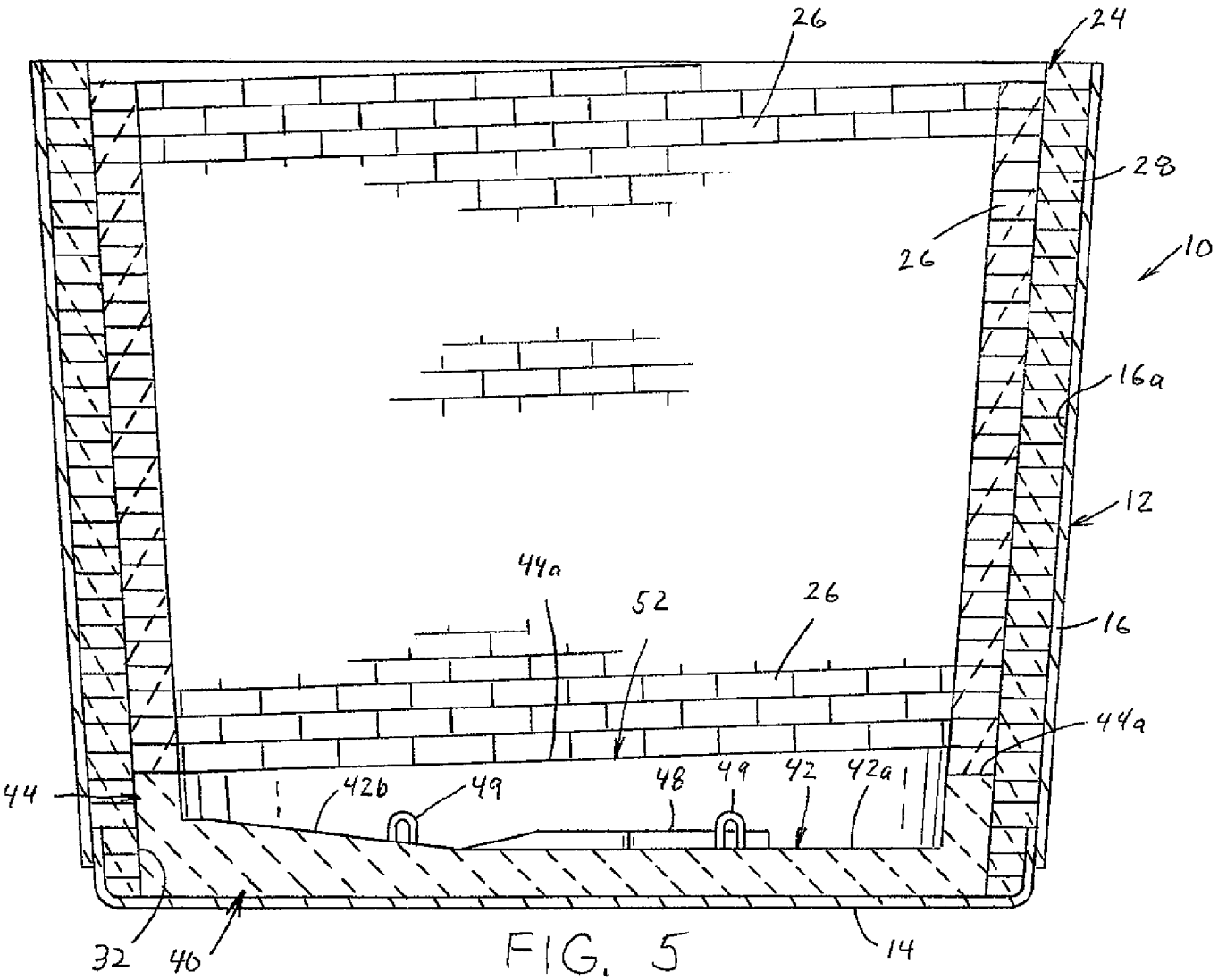
FIG. 5 is a cross-sectional view of the steel ladle shown in FIG. 4 having the preformed refractory component disposed therein.

FIGS. 4-5 show a conventional steel ladle 10, in cross section, having an outer metallic shell 12. The outer metallic shell 12 is comprised of a cup-shaped bottom 14 and a slightly conical side wall 16. To protect metal shell 12 from molten metal, a preformed refractory component 40 covers or lines bottom 14 of ladle 10 and a side lining 24 covers or lines inner surface 16*a* of side wall 16 of ladle 10.

Preformed refractory component 40 shall be described in greater detail below. Side lining 24 is comprised of two layers 26, 28 of refractory brick (best seen in FIG. 5) that are disposed along inner surface 16*a* of side wall 16 of ladle 10.

FIG. 4 shows ladle 10 with outer layer 28 of refractory brick, disposed along inner surface 16*a* of side wall 16. As indicated above, outer layer 28 can be comprised of a monolithic refractory. In the drawing, outer layer 28 of refractory brick extends along the entire surface 16*a* of side wall 16 from bottom 14 to the opened upper end of ladle 10.

Preformed refractory component 40 is adapted to be disposed on bottom 14 of ladle 10 within outer layer 28 of refractory brick, as illustrated in FIG. 5.

Inner layer 26 of refractory brick is generally referred to as the "working lining," and outer layer 28 of brick, i.e., the layer of brick between working lining and side wall 16 of metallic shell 12, is typically referred to as the "backup lining" or the "permanent lining." (As will be appreciated, the "permanent lining" is not per se "permanent" and eventually needs to be replaced, but the "permanent lining" lasts significantly longer than the "working lining" that needs to be replaced more frequently).

Figure 2:
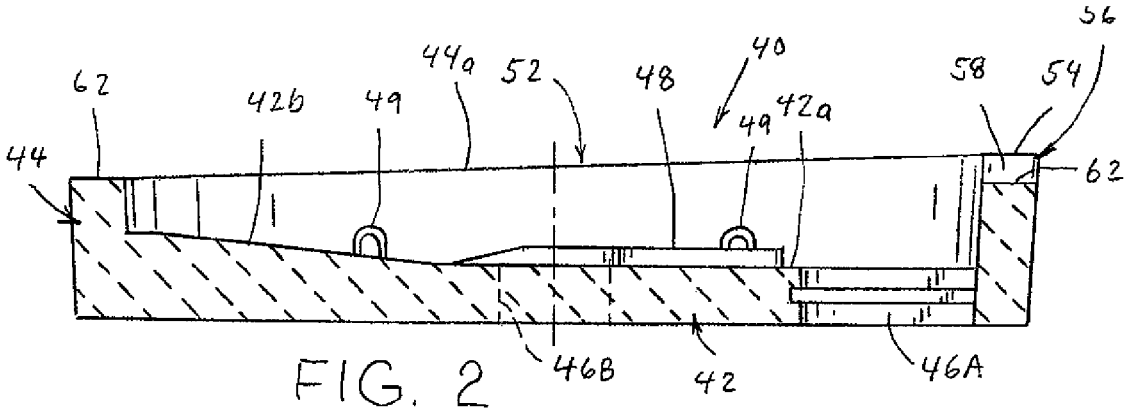
FIG. 2 is a sectional view taken along lines 2-2 of FIG. 1.
Figure 3:
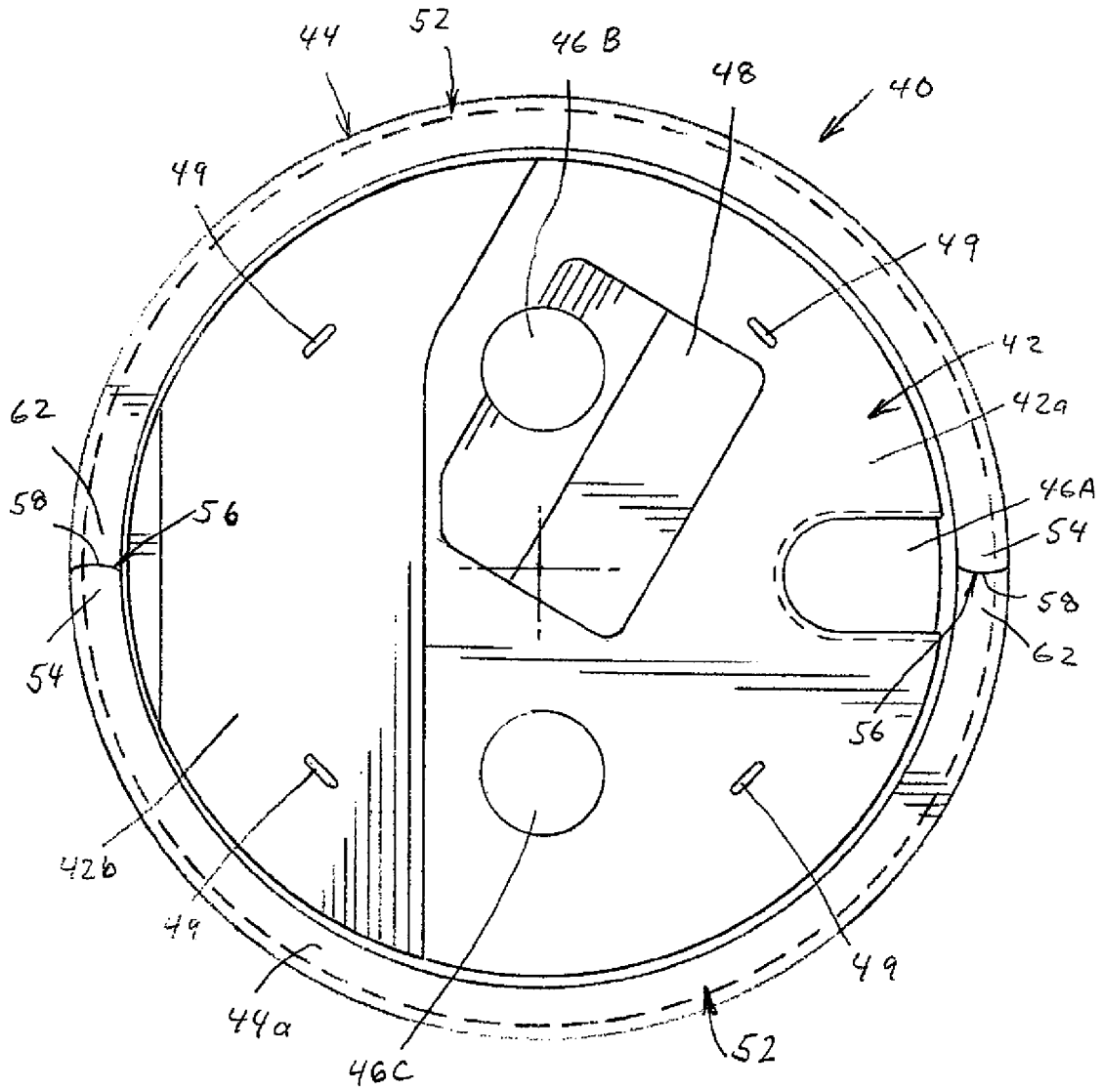
FIG. 3 is an enlarged top plan view of the preformed refractory component shown in FIG. 1.

Referring now to FIGS. 1-3, preformed refractory component 40, according to one aspect of the present invention, is best seen. As noted above, preformed refractory component 40 forms one part of a refractory assembly that lines bottom 14 and side wall 16 of ladle 10. Preformed refractory component 40 may be cast of a high-temperature refractory material, or it may include pressed refractory bricks. Preformed refractory component 40 is generally cup-shaped and is dimensioned to conform generally to the shape of bottom 14 and side wall 16 of ladle 10. As will be described in greater detail below, preformed refractory component 40 is to be disposed within an opening 32 defined by outer layer 28 of refractory brick, as illustrated in FIG. 4. In this respect, in the embodiment shown, preformed refractory component 40 is slightly conical in shape. (As will be appreciated, if side wall 16 of metallic shell 12 is straight, i.e., cylindrical, preformed refractory component 40 would be cylindrical in shape.) Preformed refractory component 40 is dimensioned to rest on bottom 14 of metallic shell 12 of steel ladle 10 or on a refractory sub-bottom (not shown).

Preformed refractory component 40 is an integrally formed, component having a bottom wall portion 42 and an annular side wall portion 44 that extends upwardly from bottom wall portion 42. In this respect, preformed refractory component 40 is generally cup-shaped. In the embodiment shown, bottom wall portion 42 has a generally flat section 42*a* and a sloping section 42*b*. Openings 46A, 46B and 46C are formed in flat section 42*a* of bottom wall portion 42 of preformed refractory component 40. Opening 46A is dimensioned to receive a well block (not shown), as is conventionally known. Preformed refractory component 40, shown in the drawings, includes an impact pad 48 projecting from the upper surface of flat section 42*a* of bottom wall portion 42. Impact pad 48 may be formed as an integral part of bottom wall portion 42, or may be a separate component that is cast or bricked within bottom wall portion 42. It is contemplated that impact pad 48 may be a cast refractory component or may be formed of refractory bricks. Sloping section 42*b* of bottom wall portion 42 is disposed and oriented to direct molten metal toward flat section 42 of bottom wall portion 42 and, in turn, toward opening 46A, where a well block is located.

Spaced-apart lifting lugs 49 are embedded into bottom wall portion 42 of preformed refractory component 40 to allow lifting and handling of preformed refractory component 40, as shall be described in greater detail below. In the embodiment shown, lifting lugs 49 are metal rods formed into a general U-shape, with the ends of the U-shaped rods embedded within bottom wall portion 42, as shown in the drawings.

Side wall portion 44 extends upwardly from bottom wall portion 42 and has a generally uniform thickness.

Side wall portion 44 of preformed refractory component 40 defines an upper surface 44*a* that is formed to define one or more ramped, helical surfaces 52 (best seen in FIG. 4). Each helical surface 52 has an elevated end 54 that defines a step 56 relative to a beginning or starting point 62 of helical surface 52. In the embodiment shown, step 56 of helical surface 52 has a rounded or curved end face 58, dimensioned to mate with a curved face on a refractory brick (not shown) that will form inner layer 26 of side lining 24 of steel ladle 10. It is contemplated that the end face of helical surface 52 could also be flat. Helical surface 52 is dimensioned such that end face 58 has a height equal to the height of the refractory brick that abuts end face 58. In the embodiment shown, two opposing helical surfaces 52 are shown. Each helical surface 52 defines a ramp to start a course of refractory brick along a helical spiral, wherein each course of brick spirals up the side of ladle 10.

It will be appreciated that upper surface 44*a* of preformed refractory component 40 may have configurations different from the ramped, helical surfaces described herein. Upper surface 44*a* may be horizontal or it may be designed to mate with a preformed annular refractory ring that would form all or part of the ladle sidewall above the upper surface 44*a* of the preformed refractory component 40.

Preformed refractory component 40 may be a monolithic structure formed of a high-temperature refractory castable, such as by way of explanation and not limitation, GREFCON®98SP sold by A.P. Green Industries, Inc. and HP-CAST®94MA-C sold by North American Refractories Co.

Referring now to FIGS. 4-5, a method of forming a protective refractory lining in steel ladle 10 using preformed refractory component 40 is shown.

FIG. 4 illustrates a ladle 10 having an outer layer 28 of refractory brick lining side wall 16 of the metallic shell 12. In FIG. 4, an inner layer 26, i.e., the "working lining," and any refractory material covering the bottom 14 of ladle 10 has been removed. As indicated above, the "backup lining" or the "permanent lining" defined by outer layer 28 of refractory brick is often reused. With the outer layer 28 of refractory brick in place, a preformed refractory component 40, as described above, is inserted into ladle 10 using chains or cables and an overhead crane or other similar lifting device. Preformed refractory component 40 is set in place over bottom wall 14 of the metallic shell 12. The bottom surface of preformed refractory component 40 is dimensioned to correspond to the bottom wall 14 of metallic shell 12. In the embodiment shown, bottom wall 14 of metallic shell 12 is generally flat. Accordingly, in the embodiment shown, the bottom surface of preformed refractory component 40 is flat to correspond to the shape of bottom wall 14. According to the present invention, the lower surface of preformed refractory component 40 is dimensioned to correspond with the shape of the bottom wall 14 of metallic shell 12 or to rest upon a refractory base material inserted in ladle 10 beneath preformed refractory component 40.

Once preformed refractory component 40 is set in place in ladle 10, a pallet (not shown) of refractory brick is set onto preformed refractory component 40 and workers may climb down into ladle 10 to install spiraling courses of refractory brick against outer layer 28 (the permanent lining) using helical surfaces 52 formed on the upper surface of preformed refractory component 40.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A metallurgical vessel used for handling molten metal, said metallurgical vessel having an outer metallic shell comprised of a bottom wall and a side wall, and a cup-shaped, preformed refractory component forming part of a refractory structure disposed above said bottom wall of said metallurgical vessel, said preformed refractory component formed of high-temperature refractory materials, said preformed refractory component having a bottom wall portion and an annular side wall portion encircling said bottom wall portion, the annular side wall portion being integrally formed with said bottom wall portion and extending upwardly therefrom, said bottom wall portion having a bottom surface dimensioned to rest upon said bottom wall of said metallurgical vessel, said annular side wall portion forming part of a working lining of a barrel of the metallurgical vessel and having an upper surface configured to accommodate or mate with refractory brick or refractory components with which a remainder of the side wall of the metallurgical vessel is comprised, wherein said upper surface of said side wall portion defines a tapered ramp.

2. A metallurgical vessel with a preformed refractory component as defined in claim 1, wherein said side wall portion is slightly conical in shape.

3. A metallurgical vessel with a preformed refractory component as defined in claim 1, wherein said upper surface is formed to define at least one tapered ramp.

4. A metallurgical vessel with a preformed refractory component as defined in claim 2, wherein the tapered ramp is a first tapered ramp, and wherein said upper surface of said side wall portion further defines a second tapered ramp, the first and second tapered ramps being disposed end to end.

5. A metallurgical vessel with a preformed refractory component as defined in claim 1, wherein the tapered ramp defines a step at one end of said ramp, said step defining a convex end surface.

6. A metallurgical vessel with a preformed refractory component as defined in claim 1, wherein said bottom wall portion includes an impact pad extending from the surface thereof.

7. A metallurgical vessel with a preformed refractory component as defined in claim 6, wherein said impact pad is integrally formed with said bottom wall portion.

8. A metallurgical vessel with a preformed refractory component as defined in claim 6, wherein said impact pad is embedded in said bottom wall portion.

9. A metallurgical vessel with a preformed refractory component as defined in claim 1, wherein said bottom wall portion includes a flat section and a tapered section.

10. A metallurgical vessel with a preformed refractory component as defined in claim 9, wherein an opening dimensioned to receive a well block is formed in said flat section of said bottom wall portion.

11. A metallurgical vessel with a preformed refractory component as defined in claim 1, wherein said lining is comprised of refractory brick.

12. A metallurgical vessel used for handling molten metal, said metallurgical vessel comprising:

an outer metallic shell comprised of a bottom wall and a side wall; and a cup-shaped, preformed refractory component forming part of a refractory structure disposed above said bottom wall of said metallurgical vessel, said preformed refractory component formed of high-temperature refractory materials, said preformed refractory component having a bottom wall portion and an annular side wall portion encircling said bottom wall portion, the annular side wall portion being integrally formed with said bottom wall portion and extending upwardly therefrom, said bottom wall portion having a bottom surface dimensioned to rest upon said bottom wall of said metallurgical vessel, said bottom wall portion having a top surface into which a plurality of lugs is embedded, said lugs being configured to allow lifting of said preformed refractory component, said annular side wall portion forming part of a working lining of a barrel of the metallurgical vessel and having an upper surface configured to accommodate or mate with refractory brick or refractory components with which a remainder of the side wall of the metallurgical vessel is comprised.

13. A metallurgical vessel used for handling molten metal, said metallurgical vessel comprising:

an outer metallic shell comprised of a bottom wall and a side wall; and a monolithic, cup-shaped, preformed refractory component forming part of a refractory structure disposed above said bottom wall of said metallurgical vessel, said preformed refractory component being comprised of high-temperature refractory materials, said preformed refractory component comprising a bottom wall portion and an annular side wall portion encircling said bottom wall portion, the annular side wall portion being integrally formed with said bottom wall portion and extending upwardly therefrom, said bottom wall portion having a bottom surface dimensioned to rest upon said bottom wall of said metallurgical vessel, said annular side wall portion forming part of a working lining of a barrel of the metallurgical vessel and having an upper surface configured to accommodate or mate with refractory brick or refractory components with which a remainder of the side wall of the metallurgical vessel is comprised.

* * * * *